US008882214B2

(12) United States Patent
Oe et al.

(10) Patent No.: US 8,882,214 B2
(45) Date of Patent: Nov. 11, 2014

(54) LIQUID CONSUMPTION DEVICE, PROGRAM, AND PRINTING DEVICE

(71) Applicant: Seiko Epson Corporation, Tokyo (JP)

(72) Inventors: Kenichi Oe, Nagano (JP); Noboru Asauchi, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 13/753,684

(22) Filed: Jan. 30, 2013

(65) Prior Publication Data

US 2013/0342594 A1 Dec. 26, 2013

(30) Foreign Application Priority Data

Jun. 25, 2012 (JP) ..... 2012-142264

(51) Int. Cl.
*B41J 2/195* (2006.01)
*B41J 2/175* (2006.01)

(52) U.S. Cl.
CPC ..... *B41J 2/17566* (2013.01); *B41J 2/17546* (2013.01)
USPC ..... 347/7

(58) Field of Classification Search
CPC ..... B41J 2/17566; B41J 2/17509; B41J 2/17513; B41J 2/17546; B41J 2/1752
USPC ..... 347/7
See application file for complete search history.

(56) References Cited

U.S. PATENT DOCUMENTS

2009/0225609 A1 9/2009 Asauchi et al.
2010/0253718 A1* 10/2010 Asauchi ..... 347/7

FOREIGN PATENT DOCUMENTS

WO 2006/129779 A1 12/2006

* cited by examiner

*Primary Examiner* — Lisa M Solomon
(74) *Attorney, Agent, or Firm* — Global IP Counselors, LLP

(57) ABSTRACT

A liquid consumption device includes a communication processing part that performs a communication process with a memory device provided in a liquid container and stores a container side liquid consumption information, a memory part that stores a main body side liquid consumption information, and a processing part. The processing part reads the main body side liquid consumption from the memory part, performs a process of counting the liquid consumption amount, updates the main side liquid consumption information based on the counted liquid consumption amount, performs a comparison process between the liquid consumption amount in the main body side and the liquid consumption amount in the liquid container side, and when an increment of the liquid consumption amount in the main body to the liquid consumption amount in a container side is greater than a determination threshold value of an allowable increment, the processing part determines as an error.

11 Claims, 9 Drawing Sheets

LIQUID CONSUMPTION DEVICE, PROGRAM, AND PRINTING DEVICE

BACKGROUND

The present invention relates to a liquid consumption device, program and a printing device.

As a liquid consumption device, an inkjet printer, a liquid ejecting device that ejects liquid including bioorganic substance used for a biochip fabrication, a sample ejecting device as a precision pipette, and the like are existed. In the inkjet printer, normally, an ink cartridge as a detachable liquid container is equipped.

As an ink cartridge, there exist that a memory device that stores various information such as an amount of ink consumption and ink color is provided. The amount of ink consumption in the ink cartridge increases in response to consuming ink, but it does not reduce. However, in fact, an ink consumption value stored in the memory device may be reduced due to some kind of a memory cell error or a communication error between the printer and the cartridge. If the amount of ink consumption stored in the memory device of the ink cartridge is reduced, although there is no ink in the ink cartridge, the printer erroneously determines there is still more remaining ink so that it cannot be printed properly. To solve such problem, the present applicant discloses a technology that provides a function (called as "decrement prohibition function") to prohibit rewriting a value of the ink consumption to a small value (Patent Document 1).

However, for some reasons, a value of ink consumption amount which is greater than the actual amount may be written in the memory device. In this case, a problem occurs that a printing cannot be executed by using the ink cartridge.

[Patent Document 1] International Application Publication No. WO2006/129779 A1

SUMMARY

According to some aspects of the present invention, it can provide a liquid consumption device, program, and a printing device that can reduce a possibility to write excess amount of liquid consumption in a memory device.

One aspect of the present invention relates to a liquid consumption device comprising: a communication processing part that performs a communication process with a memory device provided in a liquid container that stores liquid consumption amount in a liquid container side information; a memory part that stores liquid consumption amount in a main body side information; a processing part; wherein the processing part reads the liquid consumption amount in the main body side information from the memory part, performs a counting process, updates the liquid consumption amount in the main body side information based on the counted liquid consumption amount, performs a comparison process between the liquid consumption amount in the main body side based on the liquid consumption amount in the main body side information after the update and the liquid consumption amount in the liquid container side based on the liquid consumption amount in the liquid container side information that was received in the communication processing part, and when an increment, which is for the received liquid consumption amount in the container side, of the liquid consumption amount in the main body side after the update is greater than a determination threshold value of an allowable increment, the processing part determines as an error.

According to one aspect of the present invention, when an increment, which is for the received liquid consumption amount in the container side, of the liquid consumption amount in the main body side after the update is greater than the determination threshold value of the allowable increment, it is determined as an error so that when the liquid consumption amount in the main body side became an excessive value that is greater than the determination threshold value of the allowable increment caused by a memory error of the memory part, it can be determined as an error.

Also, in one aspect of the present invention, when it is not determined as the error, the processing part performs a writing process that sends a writing command and the information of the liquid consumption amount in the main body side after the update to the memory device through the communication processing part, and when it was determined as the error, the writing process may not be performed.

In this way, when the liquid consumption amount in the main body side became an excessive value that is greater than the determination threshold value of the allowable increment caused by a memory error of the memory part, it can be prevented from writing the excessive liquid consumption amount to the memory device.

Also, in one aspect of the present invention, the determination threshold value of the allowable increment is more than 50% of a liquid containable amount of the liquid container.

In this way, a value greater than the liquid consumption amount, which is consumed in a liquid consumption process at once, can be set as the determination threshold value of the allowable increment so that when the liquid consumption amount in the main body side became an excess liquid consumption amount that is greater than an actual liquid consumption amount, it can be determined as an error.

Also, in one aspect of the present invention, the processing part selects any one of determination threshold values among a plurality of determination threshold values of the allowable increment, and preforms a comparison process between the selected determination threshold value and the increment.

In this way, as a determination threshold value of the allowable increment, a desired determination threshold value can be selected from the plurality of determination threshold values so that a possibility that an excess liquid consumption amount is written in the memory device can be reduced.

Also, in one aspect of the present invention, the processing part determines the determination threshold value of the allowable increment based on reference information used for the determination threshold value of the allowable increment stored in the memory device.

In this way, a determination threshold value of a desired allowable increment can be determined based on the reference information stored in the memory device so that it becomes possible for more accurate error determination, and a possibility that an excess liquid consumption amount is written in the memory device can be reduced.

Also, in one aspect of the present invention, the reference information stored in the memory device may be information whether or not the liquid container is used for an initial filling.

In this way, when the liquid container is used for the initial filling, a determination threshold value of a desired allowable increment can be determined so that a possibility that an excess liquid consumption amount is written in the memory device can be reduced.

Also, in one aspect of the present invention, the reference information stored in the memory device may be liquid containable amount information of the liquid container.

In this way, a determination threshold value of a desired allowable increment is determined in response to the liquid containable amount of the liquid container so that a possibility that an excess liquid consumption amount is written in the memory device can be reduced.

Also, one aspect of the present invention, the processing part determines a determination threshold value of the allowable increment based on the reference information used for the determination threshold value of the allowable increment stored in the memory device.

In this way, a determination threshold value of a desired allowable increment can be determined based on information such as, e.g., a number of nozzles in the liquid consumption device stored in the memory part so that it becomes possible for an accurate error determination, and a possibility that an excess liquid consumption amount is written in the memory device can be reduced.

Also, in one aspect of the present invention, the memory device stores the liquid consumption amount in the main body side information before the update as history information, the processing part performs a comparison between the liquid consumption amount in the main body side based on the liquid consumption amount in the main body side information before the update and the liquid consumption amount in the liquid container side based on the received liquid consumption amount in the liquid container side information, and when the liquid consumption amount in the main body side before the update and the received liquid consumption amount in the liquid container side are different, it is determined as an error.

In this way, when the information stored in the memory device has an error, or when the data received from the memory device has an error, it can be determined as an error.

Another aspect of the present invention relates to a program characterized by including a program for operating a computer as a communication processing part that performs a communication process with a memory device which is provided in a liquid container and stores liquid consumption amount in a liquid container side information, a memory part that stores liquid consumption amount in a main body side information, and a processing part, wherein the processing part reads the liquid consumption amount in the main body side information from the memory part, performs a process counting the liquid consumption amount, updates the liquid consumption amount in the main body side information based on the counted liquid consumption amount, performs a comparison process between the liquid consumption amount in the main body side based on the liquid consumption amount in the main body side information after the update and the liquid consumption amount in the liquid container side based on the liquid consumption amount in the liquid container side information that was received in the communication processing part, and when an increment, which is for the received liquid consumption amount in the container side, of the liquid consumption amount in the main body side after the update is greater than a determination threshold value of an allowable increment, the processing part performs a process such that an error is determined.

In another aspect of the present invention, when an increment, which is for the received liquid consumption amount in the container side, of the liquid consumption amount in the main body side after the update is greater than a determination threshold value of an allowable increment based on the program control, the processing part determines as an error so that when the liquid consumption amount in a main body side becomes an excess value that is greater than the determination threshold value of the allowable increment due to a memory error in the memory device, it can be determined as an error.

Another aspect of the present invention relates to a printing device including any of the above described liquid consumption devices.

BRIEF DESCRIPTION OF THE DRAWINGS

The invention will be described with reference to the accompanying drawings wherein like numbers reference like elements.

DESCRIPTION OF EXEMPLARY EMBODIMENTS

Preferred embodiments of the present invention will be described in detail below. The present embodiment described below does not unduly limit the content of the present invention described in the claims, and not all of the configurations described in the present embodiment are necessarily the means for solving problems using the invention.

1. Liquid Consumption Device and Printing Device

Figure 1:
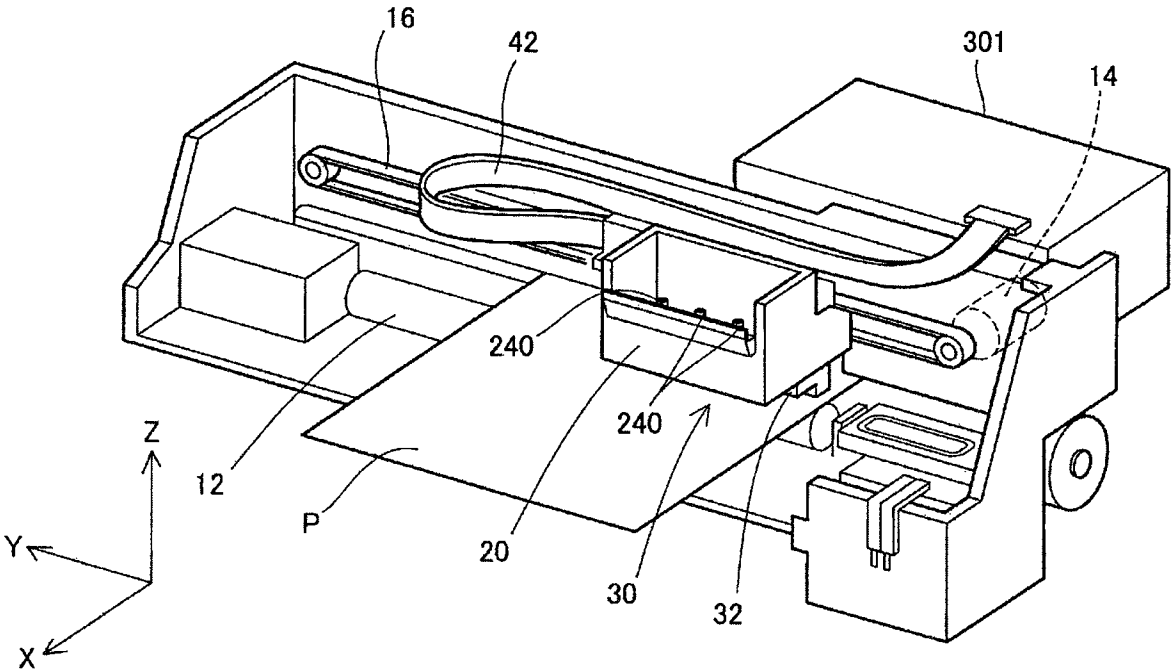
FIG. 1 The drawing is a perspective illustration showing a configuration of a printing device.

FIG. 1 is a perspective illustration showing a configuration of a printing device (called as "printer") in the present embodiment. In FIG. 1, the XYZ axis, which is orthogonal to each other, is drawn. Regarding the subsequent illustrations, the XYZ axis is denoted if it is necessary. In the present embodiment, the Z axis is a vertical direction, and a surface in the X axis direction of the printing device is a front surface in the printing device in use of posture. This printing device is a small size inkjet printer for a personal use, and it has a sub-scanning feeding mechanism, a main-scanning feeding mechanism, and a head drive mechanism. The sub-scanning feeding mechanism feeds a printing paper P in a sub-scanning direction by using a paper feed roller 12 driven by a paper feed motor which is not shown in the drawing. The main-scanning feeding mechanism reciprocates a carriage 30, which is connected to a drive belt 16, in a main-scanning direction by using a drive power of a carriage motor 14. The main-scanning direction of the printing device is the Y axis direction and the sub-scanning direction is the Z axis direction. The head drive mechanism drives a printing head 32 equipped on the carriage 30 so as to execute an ink discharge and a dot formation. In addition, the printing device has a printing device processing part 301 to perform a control process to control each mechanism as described above. The printing device processing part 301 is connected through the carriage 30 and the flexible cable 42.

The carriage 30 has a holder 20 and a printing head 32. The holder 20 has a configuration that a plurality of ink cartridges is installable, and it is arranged in an upper side of the printing head 32. The ink cartridge 10 installed in the holder 20 is arranged in the Y direction. The holder 20 is also called as "cartridge installation part". In the example shown in FIG. 1, four cartridges are independently installable in the holder 20, and for example, four types of cartridges such as black, yellow, magenta, cyan are installed one by one. An installation direction of the cartridge is the −Z direction (a vertical downward direction in the present embodiment). By the way, as the holder 20, it is utilizable to install arbitrary various types of cartridges other than this. In the upper part of the printing head 32, an ink supply pipe 240 is arranged to supply ink to the printing head 32 from the cartridge. According to such a printing device, a type that the cartridge replaced by the user is installed in the cartridge installation part (holder) on the carriage of the printing head is called as "on-carriage type".

Figure 2:
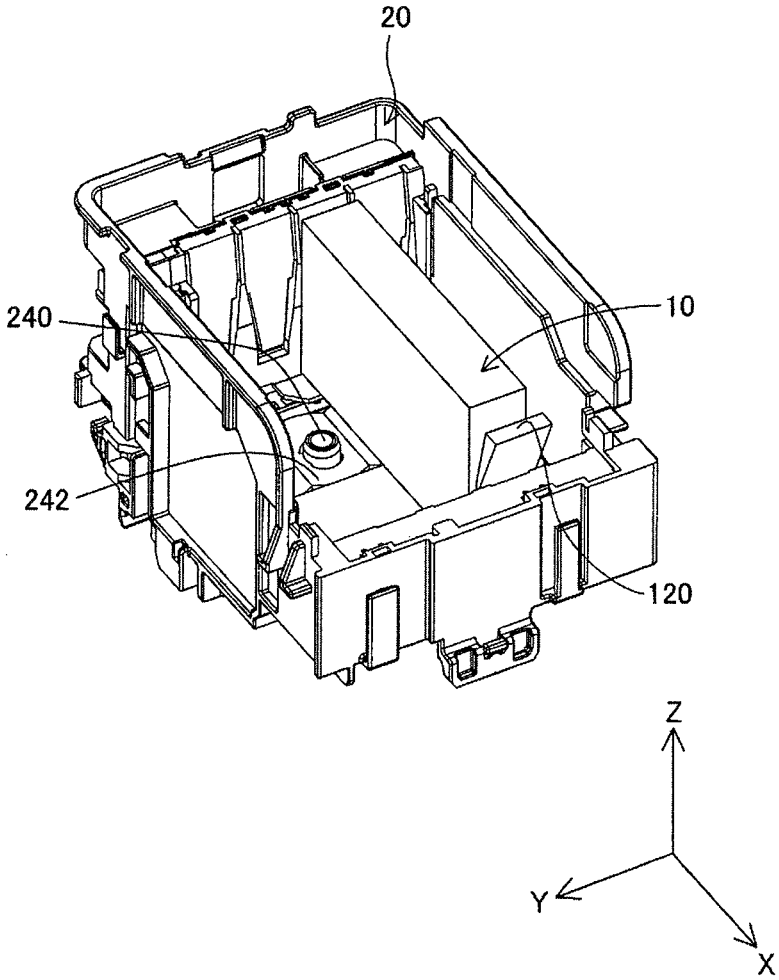
FIG. 2 The drawing is an appearance perspective illustration of a holder in which an ink cartridge is installed.

FIG. 2 is an appearance perspective illustration of the holder 20 in which the ink cartridge 10 is installed. To simplify the explanation, FIG. 2 shows a configuration that one cartridge 10 is installed in the holder 20. The holder 20 has four slots that are installable for one cartridge in each. The ink supply pipe 240 is provided in each slot of the holder 20. The ink in the cartridge 10 is supplied to the printing head 32 through the ink supply pipe 240. An elastic member 242 is provided in a circumference of the ink supply pipe 240 to seal an ink supply opening of the cartridge 10 to prevent external ink leakage. The cartridge 10 has a lever 120 as an elastic member for the elastic deformation. The user controls the lever 120 so that the cartridge 10 can be removed from the holder 20.

Figure 3:
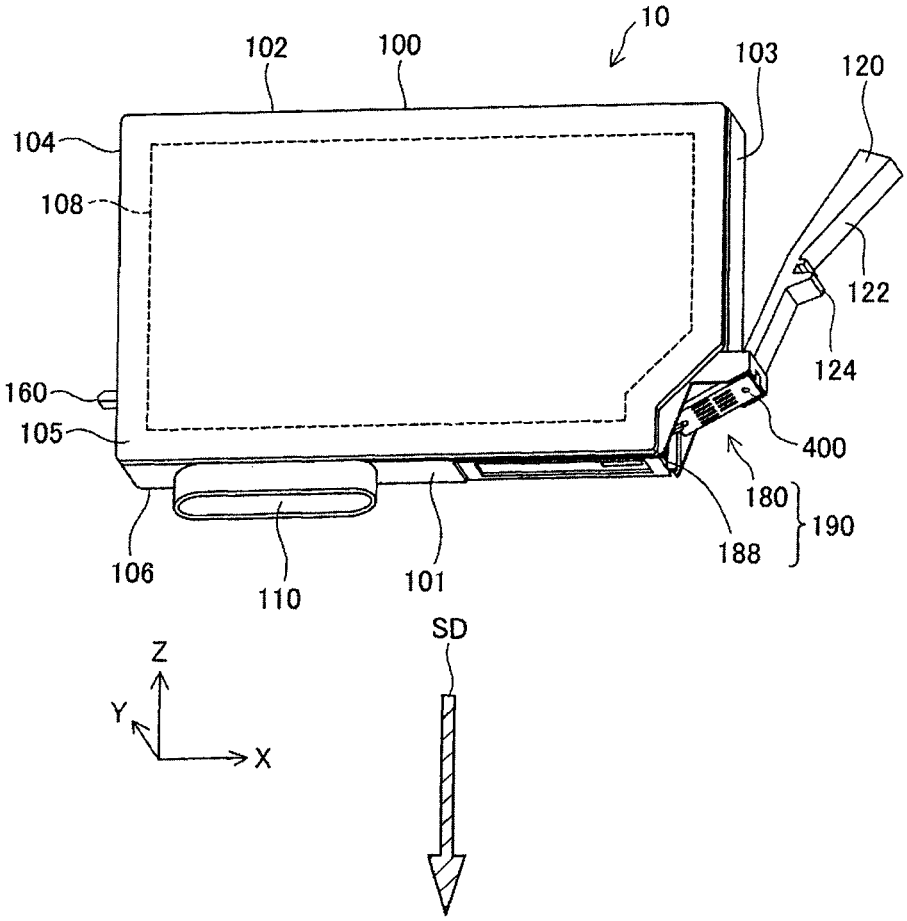
FIG. 3 The drawing is a perspective illustration of an ink cartridge.

FIG. 3 is a perspective illustration of the ink cartridge 10 according to the present embodiment. The installation direction SD when the cartridge 10 is installed in the holder 20 is the −Z direction (a vertical downward direction in the present embodiment). This cartridge 10 has an ink containing part 10 that contains ink (it is also called as "ink container" or "chassis"), and a circuit substrate 400 (simply, it is also called as "substrate"). The inside part of the ink containing part 100 forms an ink chamber 108 that contains the ink. As a whole, the ink containing part 100 has a configuration of substantially rectangular parallelepiped, and it has six surfaces of a bottom surface 101, an upper surface 102, a front surface 103, a back surface 104, a left side surface 105, and a right side surface 106. In the bottom surface 101, when the cartridge 10 is installed in the holder 20, the ink supply opening 110 connected with the ink supply pipe 240 of the printing device is formed. In a condition before use, an opening of the ink supply opening 110 may be sealed by a cap, a film, or the like.

The lever 120 is provided in the front surface 103. In the lever 120, an engagement release part 122 and an engagement projection 124 are provided. This lever 120 is used when the cartridge 10 is installed to and removed from the holder 20. That is, by pressing the lever 120 by the user, the engagement projection 124 and the engagement part of the holder 20 are mechanically engaged, and also, the engagement can be released. In the back surface 104, an engagement projection 160 is provided. This engagement projection 160 is also engaged with the engagement part of the holder 20, and it has a function to maintain a condition that the cartridge 10 is installed.

In an intersectional position between the bottom surface 101 and the front surface 103 (that is, a corner part of front surface inferior end of the ink containing part 100), a substrate installation part 180 is formed, and a substrate 400 is installed in the substrate installation part 180. The substrate installation part 180 has a configuration as a slop inclined to the bottom surface 101. More detail, in the end part of the front surface 103 side of the bottom surface 101, an overhang part 190 including the substrate installation part 180 and a stepped part 188 is provided. The stepped part 180 is a part rising upward from the bottom surface 101. The substrate installation part 180 is provided in an upper position of the stepped part 188. In the substrate installation part 180, the circuit substrate 400 is provided in a downward state of the substrate surface. By the way, such a configuration of the ink cartridge is one example, and it is possible to adapt an ink cartridge having another arbitrary configuration.

Figure 4:
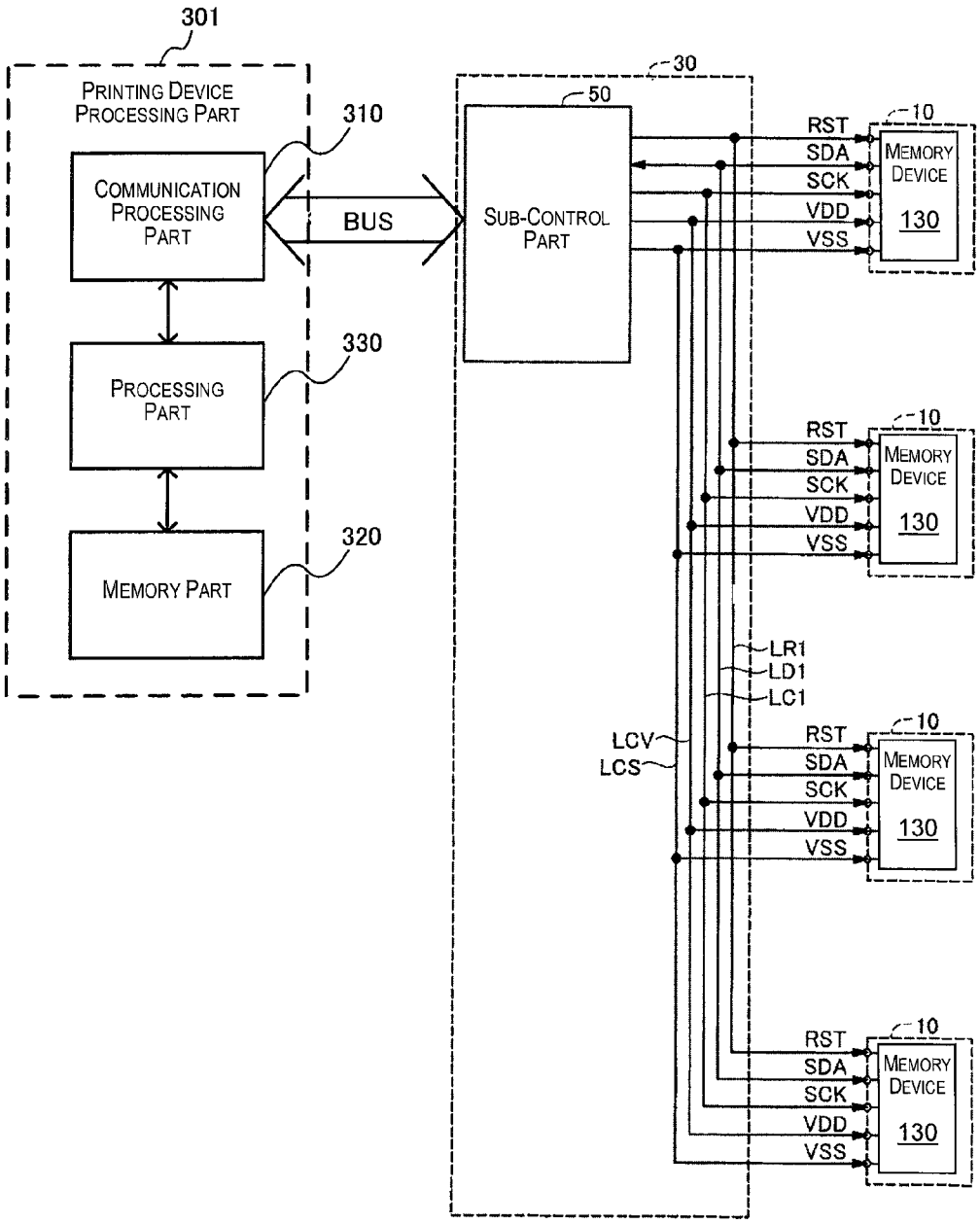
FIG. 4 The drawing is a basic configuration example of a printing device.

FIG. 4 shows a basic configuration example of the printing device (liquid consumption device) of the present embodiment. The printing device includes a printing device processing part 301, a sub-control part 50, and a memory device 130. The printing device 301 includes a communication processing part 310, a memory part 320, a processing part 330. The sub-control part 50 is provided on the carriage 30, and the memory device 130 is provided on the ink cartridge 10 (liquid container). By the way, the printing device of the present embodiment is not limited to the configuration of FIG. 4 so that it is possible to have various modifications of embodiments such that a part of the constituent element may be omitted, it may be substituted to another constituent element, or another constituent element may be added.

The printing device processing part 301 and the sub-control part 50 are connected by a bus wiring BUS. The printing device processing part 301 performs the entire printing device control and issues various signals for a print execution to the sub-control part 50. The sub-control part 50 supplies power to the memory device 130 of each ink cartridge 10, and also, sends a command, which indicates a type of access for the memory device 130, based on the control of the printing device processing part 301 so as to execute writing data to the memory device 130 and reading data from the memory device 130. In addition, the sub-control part 50 has functions such as an installation detection of the cartridge 10, excess voltage detection in the circuit substrate 400 of the cartridge 10, and the like. By the way, it may be a configuration that the printing device processing part 301 and the memory device 130 perform a direct communication without providing the sub-control part 50.

The communication processing part 310 performs a communication process with the memory device 130 through the sub-control part 50 or the communication processing part 310 performs a communication process with the memory device 130 directly. Concretely, a process for receiving ink consumption amount in the ink cartridge side information (liquid consumption amount in the liquid container side information) stored in the memory device 130 is performed, and also, a process for sending ink consumption amount in the main body side information after the update (ink consumption amount in the printing device processing part side information, ink consumption amount information stored in the printing device processing part 301, liquid consumption amount in the main body side information), which is stored in the memory part 320 of the printing device processing part 301, to the memory device 130 is performed. In a case of the transmission process, the communication processing part 310 sends an ID number (identification information) of the memory device 130, a writing command, and ink consumption amount in the main body side information after the update to the memory device 130.

The memory part 320 is configured by e.g., the DRAM and the non-volatile memory, and it stores the ink consumption amount in the main body side information. Concretely, it stores the ink consumption amount in the main body side information before the update, and the ink consumption amount in the main body side information after the update. Also, the memory part 320 may also store a determination threshold value of an allowable increment, and information to determine the determination threshold value of the allowable increment.

The ink consumption amount is an ink amount consumed from one ink cartridge by a printing process of the printing device. Concretely, it represents a relative value of an amount of ink used for actual printing, head maintenance, or the like, which counts as 100%, among the ink stored in the ink cartridge. Specifically, the ink consumption amount is 0% when the ink cartridge is installed at the beginning, and the value gradually increases in accordance with the execution of printing.

The processing part 330 is e.g., the CPU. It executes to control entire printing device and performs a process related to the ink consumption amount. Concretely, ink consumption amount counting process is performed during a printing execution, and the ink consumption amount in the main body side information is updated based on the counted ink consumption amount. That is, the processing part 330 performs a counting process of an ink amount, which is consumed during an execution of printing, and the ink consumption amount in the main body side information stored in the memory part 320 is updated to the latest information based on the counted ink consumption amount. For example, the ink consumption amount at the time of the previous update was 20%, and after that, if 10% of the ink was consumed, the ink consumption amount in the main body is rewritten to 30%. In this way, in the ink consumption amount in the main side information, the ink consumption amount value increases (increment) with the execution of the print. Also, when the ink was used for head maintenance, the processing part 330 performs a counting process for the used ink amount, and the ink consumption amount in the main body side information stored in the memory part 320 is updated to the latest information.

The processing part 330 performs a writing process to the memory device 130 of the ink cartridge for the ink consumption amount in the main body side information at a predetermined timing. That is, the processing part 330 sends a writing command and the ink consumption amount in the main body side information after the update through the communication processing part 310. The memory device 130 updates the ink consumption amount in the ink cartridge side information based on the received ink consumption amount in the main body side information. Because of this, for the ink consumption amount in the ink cartridge side information, the ink consumption amount value increases (increment) at a predetermined timing.

Prior to the execution of the printing process, the processing part 330 reads each of the ink consumption amount in the ink cartridge side information from the memory device 130 of each ink cartridge 10, and a process can be performed in response to the ink remaining amount of each ink cartridge. For example, when the ink consumption amount is more than 90%, a message that indicates to prepare for a replacement of the cartridge can be displayed for the user. Also, for example, when the ink consumption amount reached 10%, a printing process is stopped due to the determination of the ink end, and a warning message can be displayed for the user.

In the actual printing device, a value of the ink consumption amount in the main body side may become a large value due to a memory error of the memory part 320 (e.g., DRAM). For example, the ink consumption amount in the main body side after the update is 30% correctly, but it may be set 10% as an excess value due to the memory error. If this error ink consumption amount was written in the memory device 130 of the ink cartridge 10, the ink cartridge would be determined as the ink end by the processing part 330 so that it cannot be used although the ink remains.

In the printing device of the present embodiment, it can reduce a possibility to write the excess ink consumption amount as described above in the memory device 130. Concretely, prior to the writing process, the processing part 330 reads the ink consumption amount in the ink cartridge side information from the memory device 130. Next, it performs a comparison process between the ink consumption amount in the main body side WDH2 based on the ink consumption amount in the main body side information after the update and the ink consumption amount in the ink cartridge side WDC1 based on the ink consumption amount in the ink cartridge side information received in the communication processing part 310. This comparison process is not limited to a direct comparison of the ink consumption amount. For example, it may be an amount corresponding to the ink consumption amount.

And, when an increment WDH2−WDC1, which is for the received ink consumption amount in the ink cartridge side WDC1, of the ink consumption amount in the main body side after the update WDH2 is greater than the determination threshold value δ of the allowable increment, the processing part 330 determines an error. When it is not determined as an error, a writing process is performed to send a writing command and the ink consumption amount in the main body side information to the memory device 130 through the communication processing part 310. On the other hand, when it is determined as an error, a writing process is not performed.

For example, in the previous writing process, the ink consumption amount in the ink cartridge WDC1=20% was written in the memory device 130. 10% of the ink was consumed by the execution of the printing, but when the processing part 330 rewrote the ink consumption amount in the main body side in the memory part 320, the ink consumption amount in the main body side was updated to 100% due to the memory error. In this case, the increment WDH2−WDC1, which is for the received ink consumption amount in the ink cartridge side WDC1, of the ink consumption amount in the main body side after the update WDH2 becomes 80%. When the determination threshold value δ of the allowable increment is set to e.g., δ=70%, it becomes WDH2−WDC1>δ so that it can be determined as an error. Because of this, in the printing device of the present invention, when the ink consumption amount in the main body side became an excess value that is greater than the determination threshold value of the allowable increment due to the memory error of the memory part 320, it can be prevented from writing the excess ink consumption amount to the memory device 130. As a result, it can reduce a possibility to become unusable although the ink remains in the ink cartridge.

As a determination threshold value of an allowable increment δ, it is preferable to set a value greater than an ink amount consumed in the printing process at any one time in the printing device. As a determination threshold value of an allowable increment δ, for example, the ink containing amount of the ink cartridge is set more than 50%. However, when an excess large value is set as a determination threshold value of an allowable increment δ, it is not preferable because a possibility that the ink consumption amount greater than the actual amount may be written in the memory device 130 by the memory error is high. Accordingly, it is desirable to set a determination threshold value of an allowable increment δ with the consideration of these points.

In addition, a proper value as a determination threshold value of an allowable increment δ is different depending on a type and a specification of the ink cartridge. For example, a cartridge included with the shipment of the printing device performs a filling process (called as "initial filling") for filling ink to an ink channel from the cartridge to the print head on an initial start-up of the printing device. A large ink amount is consumed from the cartridge in this initial filling so that it is preferable to set a value which is larger than the consumed ink amount in the initial filling as a determination threshold value of an allowable increment δ.

Also, in a printing device having a large number of nozzles, a large amount of ink consumption is required for cleaning the nozzles by the ink discharge so that it is preferable to set a large value as a determination threshold value of an allowable increment δ. On the other hand, in a cartridge having a large amount of initial ink (ink containing amount), or a printing device having a small number of nozzles, it is preferable to set a small value as a determination threshold value of an allowable increment δ.

In the printing device of the present embodiment, the processing part 330 selects any one determination threshold value among a plurality of determination threshold values of an allowable increment δ, and a comparison process can be performed between the selected determination threshold value and the increment. Also, a determination threshold value of an allowable increment δ can be determined based on reference information stored in the memory device 130 and used for determining a determination threshold value of an allowable increment which is, for example, information whether or not the cartridge is used for an initial filling or ink containing amount information of the cartridge. Moreover, a determination threshold value of an allowable increment δ can be determined based on reference information stored in the memory device 320 and used for determining a determination threshold value of an allowable increment which is, for example, information of number of nozzles. Because of this, a possibility of writing an excess ink consumption amount to the memory device 130 can be more reduced.

Concretely, the processing part 330 can set, e.g., the following values as a determination threshold value of an allowable increment δ based on information whether or not this is an ink containing amount of the cartridge stored in the memory device 130 and the cartridge for the initial filling, and nozzle number information of the printing device stored in the memory part 320. (1) A determination threshold value of an allowable increment δ1=50%: in a case of a cartridge for an initial filling. (2) A determination threshold value of an allowable increment δ2=40%: in a case of a printing device having a large number of nozzles. (3) A determination threshold value of an allowable increment δ3=30%: in a case of a printing device having a small number of nozzles. (4) A determination threshold value of an allowable increment δ4=20%: in a case of a cartridge having a large amount of initial ink. For example, the above described determination threshold values δ1 to δ4 can be preliminary stored in the non-volatile memory of the printing device processing part 301. Also, the determination threshold values δ1 to δ4 can be changed.

By the way, a determination threshold value of an allowable increment δ is set larger than a minimum difference, which can be taken in an ink consumption amount, (e.g., 1/256 as a value corresponding to a minimum bit when the ink consumption amount is presented in 8 bit). For example, each of the determination threshold value of an allowable increment δ is selected from a proper value in a range of 10% to 90%. Also, it is preferable that the minimum value of the determination threshold value of an allowable increment δ is set to be adequately larger than the ink consumption amount of printing at one time in the printing device, and the ink consumption amount of head cleaning at one time. By the way, only one value (e.g., 70%) may be used as a determination threshold value of an allowable increment δ.

2. Ink Cartridge and Memory Device

In the memory device 130 of each ink cartridge 10, an ID number (identification information) different from each other is assigned. The memory device 130 of a plurality of ink cartridges 10 is connected in parallel to a wiring from the sub-control part 50 (that is, bus connection). When a reading and writing process of data for the memory device 130 of a specific ink cartridge 10 from the sub-control part 50 is executed, as described later, the sub-control part 50 sends the ID number of the memory device 130 of the specific ink cartridge 10 to all of the ink cartridges 10 so that one ink cartridge 10 for an access target is identified (that is, one memory device 130).

A wire that electrically connects between the sub-control part 50 and the memory device 130 of each ink cartridge 10 includes a reset signal wire LR1, a clock signal wire LC1, a data signal wire LD1, a grounding wire LCS, and a power source wire LCV. The reset signal wire LR1 is a wire that supplies a reset signal RST to the memory device 130 from the sub-control part 50. For example, when a low level reset signal RST is supplied to the memory device 130 from the sub-control part 50, the memory device 130 becomes an initialized state. The clock signal wire LC1 is a wire that supplies a clock signal SCK to the memory device 130 from the sub-control part 50. The data signal wire LD1 is a wire that electrically transfers a data signal SDA between the memory device 130 and the sub-control part 50 reciprocally. The data signal SDA is synchronized with the clock signal SCK and it is transferred and received. The grounding wire LCS is a wire that supplies a ground potential VSS to the memory device 130. The power source wire LCV is a wire that supplies a power voltage VDD, which becomes as operating voltage of the memory device 130, to the memory device 130.

Figure 5A:
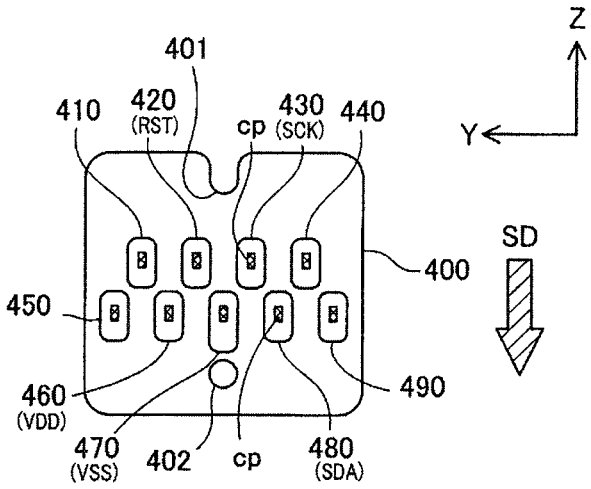
FIG. 5(A) and FIG. 5(B) are a configuration example of a circuit substrate provided in an ink cartridge.
Figure 5B:
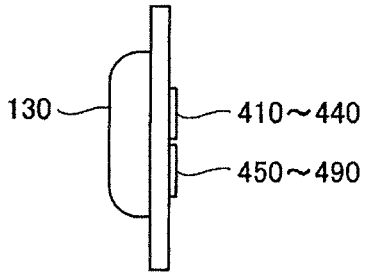

FIG. 5(A) and FIG. 5(B) shows a configuration example of a circuit substrate 400 provided in the ink cartridge 10. FIG. 5(A) shows a configuration of a surface of the circuit substrate 400. FIG. 5(B) shows a side surface view of the circuit substrate 400. The surface of the circuit substrate 400 is a surface exposed to outside when the cartridge 10 is installed. By the way, an arrow SD in FIG. 5(A) indicates an installation direction of the cartridge 10 to the holder 20.

As shown in FIG. 5(A), a boss groove 401 is formed in the upper end part of the circuit substrate 400, and a boss hole 402 is formed in the lower end part of the circuit substrate 400. The circuit substrate 400 has a terminal group having 9 terminals 410 to 490 arranged on the surface, and a memory device 130. The memory device 130 arranged on the back surface stores ID information (identification information) of the cartridge 10, information related to ink (e.g., ink consumption amount and ink color), and the like. Each of the terminals 410 to 490 forms a substantially rectangular shape, and they are arranged in two lines as a Z axis line (SD insertion direction) and a substantially perpendicular line.

In a middle part, each of the terminals 410 to 490 includes a contact part cp that contacts with a correspondence terminal among the terminals in the device side mounted on the holder 20. The terminals 410 to 440 forming the upper side line and the terminals 450 to 490 forming the lower side line respectively have, for example, the following functions (use).

<Upper side line> (1) an excess voltage detection terminal 410 (2) a reset terminal 420 (3) a clock terminal 430 (4) an excess voltage detection terminal 440 <Lower side line> (5) an installation detection terminal 450 (6) a power source terminal 460 (7) an earth terminal 470 (8) a data terminal 480 (9) an installation detection terminal 490. As shown in FIG. 4, the reset terminal 420, the clock terminal 430, the power source terminal 460, the contact terminal 470, and the data terminal 480 are connected to wires of LR1, LC1, LCV, LCS, LD1, respectively. The excess voltage detection terminals 410, 440, and the installation detection terminals 450, 490 are also connected to the sub-control part 50, but the connections are omitted in FIG. 4. A part of the excess voltage detection terminals 410, 440 is a terminal to detect abnormally high voltage (called as "excess voltage"). A part of the installation detection terminals 450, 490 is used to detect right and wrong of the installation state of the cartridge. By the way, the excess voltage detection terminals 410, 440 may be used for other installation detection of the excess voltage detection. In the example of the present configuration, a voltage (e.g., rating 42V or rating 36V) which is higher than the power source voltage (rating 3.3V) for the memory device 130 is applied to the installation detection terminals 450, 490. Other five terminals 420, 430, 460, 470, 480 are a terminal for the memory device 130. Among these five terminals, other than the earth terminal 470, a voltage (e.g., rating 3.3V) which is lower than the high voltage terminals is applied to four terminals 420, 430, 460, 480. By the way, the number and the arrangement of the terminals on the circuit substrate 400 shown in FIG. 5 is simply one example, and it is possible to employ an arbitrary configuration of the circuit substrate other than this configuration.

Figure 6:
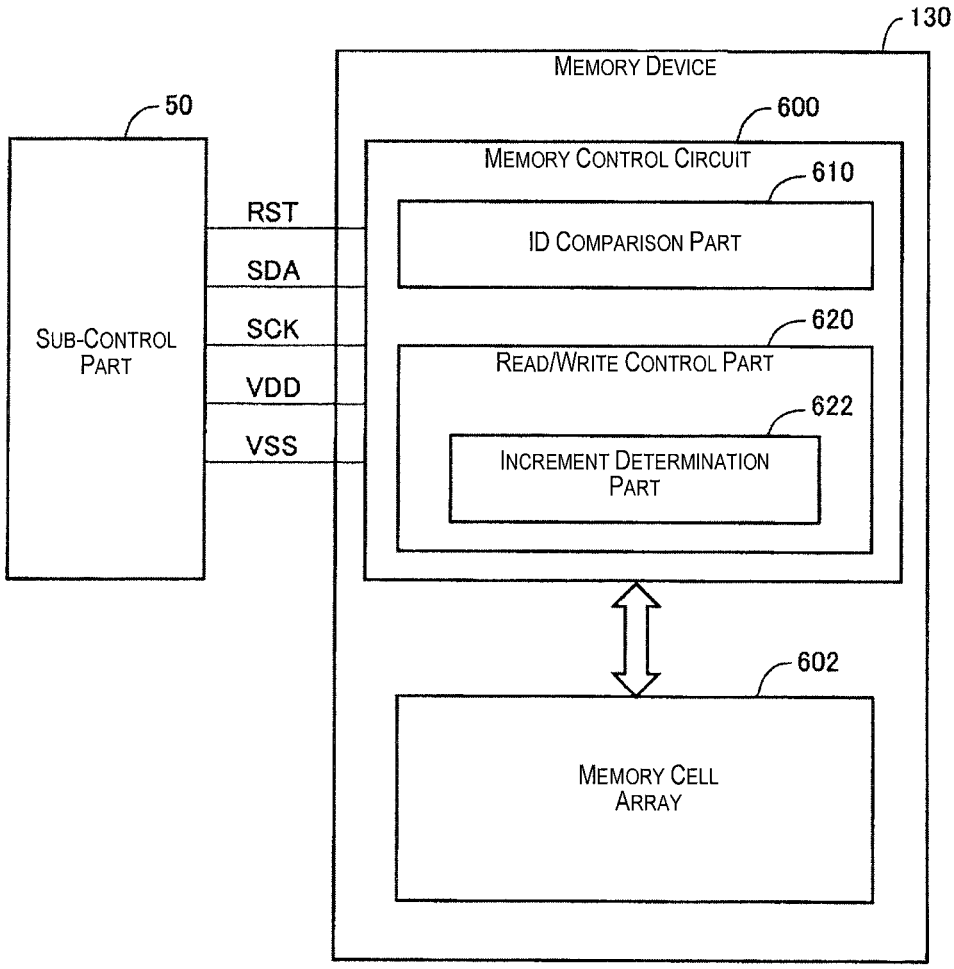
FIG. 6 The drawing is a configuration example of a memory device.

A configuration example of the memory device 130 of the cartridge 10 is shown in FIG. 6. The memory device 130 uses a sequential access method which does not require inputting address data to designate an address of an address destination from an external part. The memory device 130 has a memory control circuit 600, and a memory cell array 602. The memory control circuit 600 connects with the sub-control part 50 on the carriage of the printing device.

The memory control circuit 600 includes an ID comparison part 610, and a read/write control part 620. The read/write control part 620 includes an increment determination part 622. After starting the power source supply to the memory device 130 and synchronizing with the clock SCK after the reset signal RST became the low level to the high level, the sub-control part 50 sends an ID number through the data wire. The ID comparison part 610 compares the ID number sent from the sub-control part 50 and the ID number (identification number) preliminary stored in the memory array 602, and it determines whether or not a destination of an access from the sub-control part 50 is for the memory device 130. The read/write control part 620 controls reading and writing data of the memory array 602.

When receiving a writing command, the increment determination part 622 compares a value (updated value) of the ink consumption amount received from the sub-control part 50 and a value (previously stored value) of the ink consumption amount previously stored in the memory cell array 602, and when the updated value is more than the previously stored value, it allows to write the updated value. Because of this, for example, when the value (updated value) of the ink consumption amount received from the sub-control part 50 was smaller than the actual value due to a communication error, or the like, the value of the ink consumption amount stored in the memory device 130 can be prevented from rewriting to the small value.

3. Writing Process of Ink Consumption Amount Information

Figure 7:
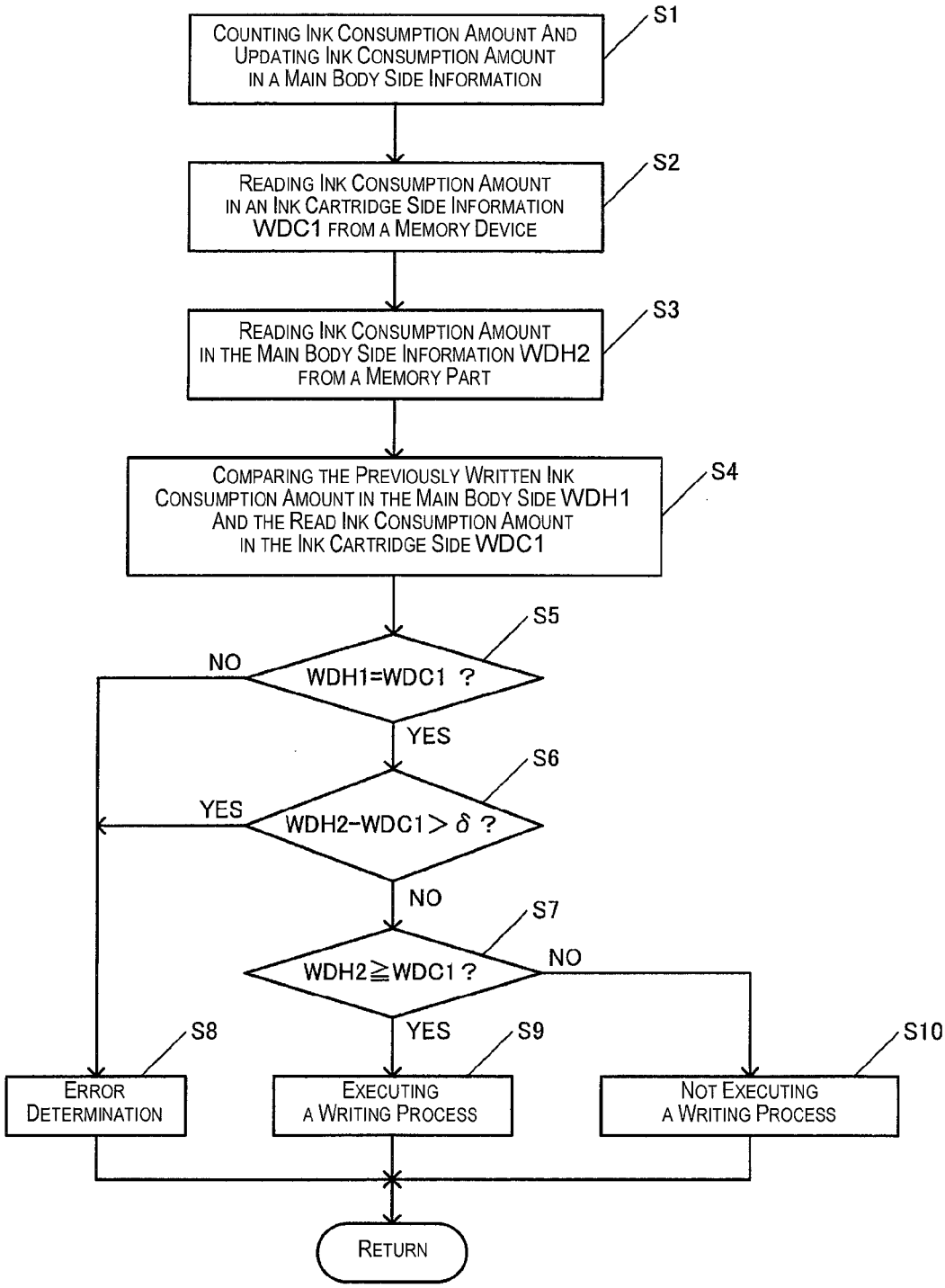
FIG. 7 The drawing is an example of a flowchart of a writing process of ink consumption information.

FIG. 7 is an example of a flowchart of the writing process of the ink consumption amount information in the printing device. The processing part 330 executes the process shown in FIG. 7 by controlling program. As an information memory medium, it can be various recording mediums such as a memory device of a RAM, a non-volatile memory, or the like, a hard disc, an optical disc, a magnetooptical disc, or the like The processing part 330 performs a process to count the ink amount consumed during the printing process, and updates to the latest information for the ink consumption amount in the main body side information stored in the memory part 320 based on the counted ink consumption amount (Step S1). For example, the ink consumption amount WDH1 was 20% at the time of the previous update, and after that, when 10% of the ink was consumed, the ink consumption amount in the main body side is rewritten into 30% as the latest ink consumption amount in the main body side WDH2.

Next, the processing part 330 reads the ink consumption amount in the ink cartridge side information WDC1 from the memory device 130 through the communication processing part 310 (Step S2). The ink consumption amount in the ink cartridge side information WDC1 is the information that was written in the memory device 130 by the previous writing process.

Next, the processing part 330 reads out the ink consumption amount in the main body side information WDH2 from the memory part 320 (Step S3). This ink consumption amount in the main body side information WDH2 is the information that was updated in Step S1.

The processing part 330 compares the ink consumption amount in the main body side WDH1 of the previous writing time and the ink consumption amount in the ink cartridge side information WDC1 that was read from the memory device 130 (Step S4). The ink consumption amount in the main body side WDH1 of the previous writing time is stored in the memory part 320 as the history information.

Next, the processing part 330 determines whether or not the ink consumption amount in the main body side WDH1 and the ink consumption amount in the ink cartridge side information WDC1 are equal (Step S5). When they are the equal, it proceeds to Step S6, and when it is not equal, it determines as an error (Step S8). That is, the processing part 330 compares the ink consumption amount in the main body side WDH1 based on the ink consumption amount in the main body side information before the update and the ink consumption amount in the ink cartridge side WDC1 based on the received ink consumption amount in the ink cartridge side information, and when the ink consumption amount in the main body side WDH1 before the update and the received ink consumption amount in the ink cartridge side WDC1 are different, it determines as an error. Because of this, when the information stored in the memory device 130 has an error, or when the receive data received from the memory device 130 has an error, it can determine as an error. When it determines as an error, the processing part 330 can indicates the user to reinstall the ink cartridge.

In Step S6, the processing part 330 determines whether or not the increment WDH2−WDC1, which is for the received ink consumption amount in the ink cartridge side WDC1, of the ink consumption amount in the main body side after the update WDH2 is greater than the determination threshold value of the allowable increment δ. When the increment WDH2−WDC1 is greater than the determination threshold value of the allowable increment δ, it determines as an error (Step S8). Because of this, when the ink consumption amount in the main body side becomes an excess value due to the memory error of the memory part 320, it can be reduced to write the excess ink consumption amount to the memory device 130.

When the increment WDH2−WDC1 is not greater than the determination threshold value of the allowable increment δ, the processing part 330 determines whether or not the ink consumption amount in the main body side after the update WDH2 is more than the received ink consumption amount in the ink cartridge side WDC1 (Step S7). When the ink consumption amount in the main body side after the update WDH2 is more than the received ink consumption amount in the ink cartridge side WDC1, the processing part 330 executes the writing process (Step S9). That is, the processing part 330 sends the writing command and the ink consumption amount in the main body side information after the update WDH2 to the memory device 130 through the communication processing part 310. The memory device 130 updates the ink consumption amount in the ink cartridge side information based on the received ink consumption amount in the main body side information WDH2.

On the other hand, when the ink consumption amount in the main body side after the update WDH2 is less than the received ink consumption amount in the ink cartridge side WDC1, the processing part 330 does not execute the writing processing (Step S10). Because of this, when the ink consumption amount in the main body side becomes smaller than the actual value due to the memory error of the memory part 320, the ink consumption amount in the ink cartridge side can be prevented from rewriting to a value smaller than the previously updated ink consumption amount WDC1.

Figure 8:
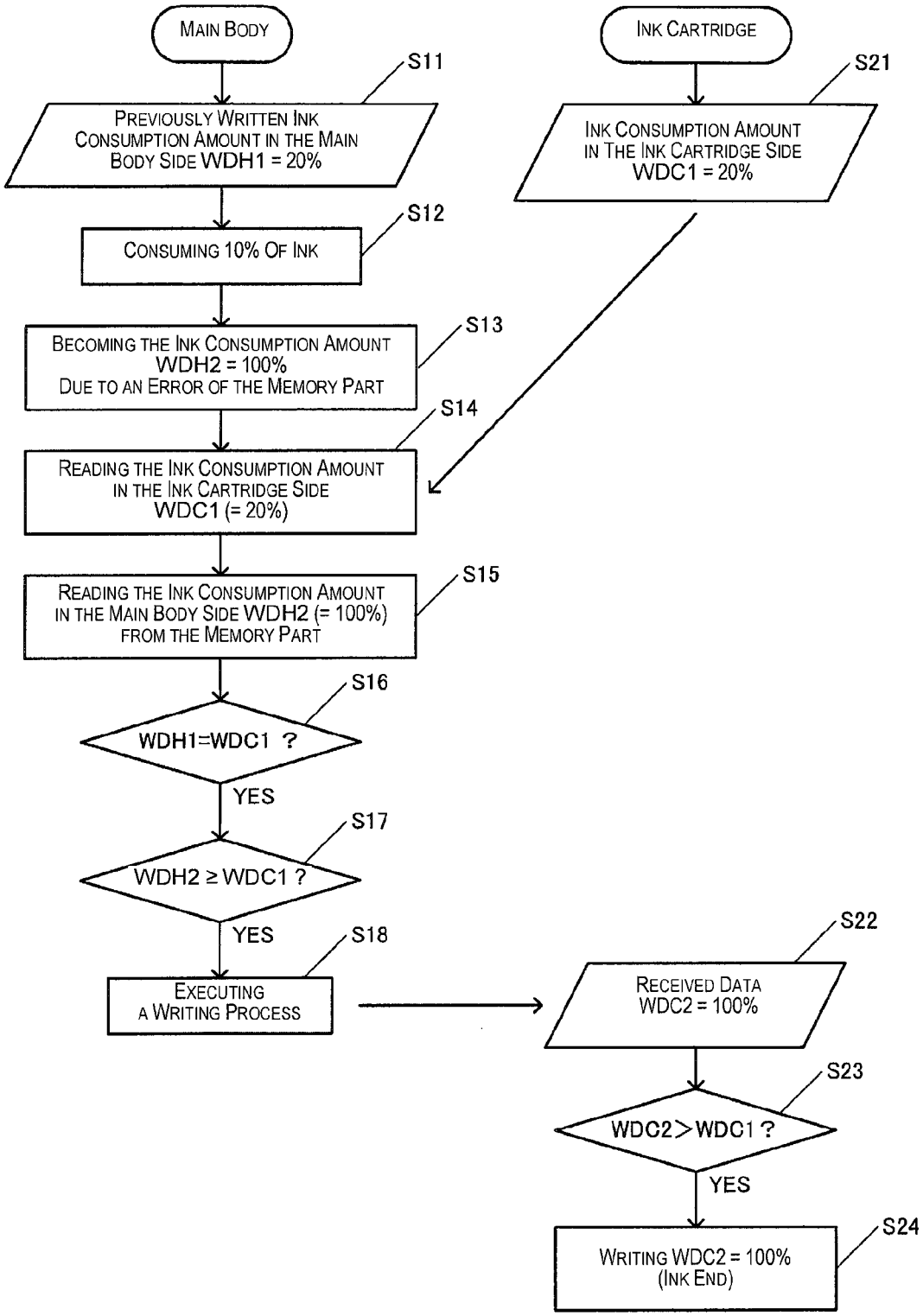
FIG. 8 The drawing is a flowchart of a configuration that a determination of an allowable increment is not performed.

FIG. 8 shows a flowchart of a configuration that does not perform a determination of an allowable increment as a comparative example. As shown in Step S11, in the memory part 320 of the main body, the ink consumption amount that was written to the memory device 130 in the previous writing process by the processing part 330, that is, the ink consumption amount in the main body side WDH1=20%, is stored as the history information. Also, the memory device 130 of the ink cartridge 10 stores the ink consumption amount in the ink cartridge side WDC1=20% that was written in the previous writing process (Step S21).

In addition, by the printing process, 10% of ink was consumed (Step S12), and the processing part 330 performs a process to update (rewrite) to 30% as a latest value for the ink consumption amount in the main body side. However, by the error of the memory part 330, the ink consumption amount in the main body side after the update becomes WDH2=100% (Step S13).

Next, the processing part 330 reads the ink consumption amount in the ink cartridge side WDC1=20% from the memory device 130 (Step S14), and in addition, the ink consumption amount in the main body side after the update WDH2=100% is read from the memory part 320 (Step S15).

The processing part 330 determines whether or not the ink consumption amount in the main body side WDH1 and the ink consumption amount in the ink cartridge side WDC1 are equal (Step S16), and the WDH1 and WDC1 are both 20% which is equal so that it proceeds to Step S17. In Step S17, the processing part 330 determines whether or not the ink consumption amount in the main body side after the update WDH2 is more than the received ink consumption amount in the ink cartridge side WDC1. WDH2=100%, and WDC1=20% so that the processing part 330 executes the writing process (Step S18), the memory device 130 receives the ink consumption amount in the ink cartridge side WDC2=100% as the receive data (Step S22).

The memory device 130 determines whether or not the received ink consumption amount in the ink cartridge side WDC2 is more than the previously written ink consumption amount in the ink cartridge side WDC1 (Step S23). WDC2=100%, and WDC1=20% so that the memory device 130 rewrites the ink consumption amount in the ink cartridge side to the received value WDC2=100% (Step S24). As a result, in the next printing process, the ink cartridge will be determined as the ink end so that it can be used although the ink is still remaining.

Figure 9:
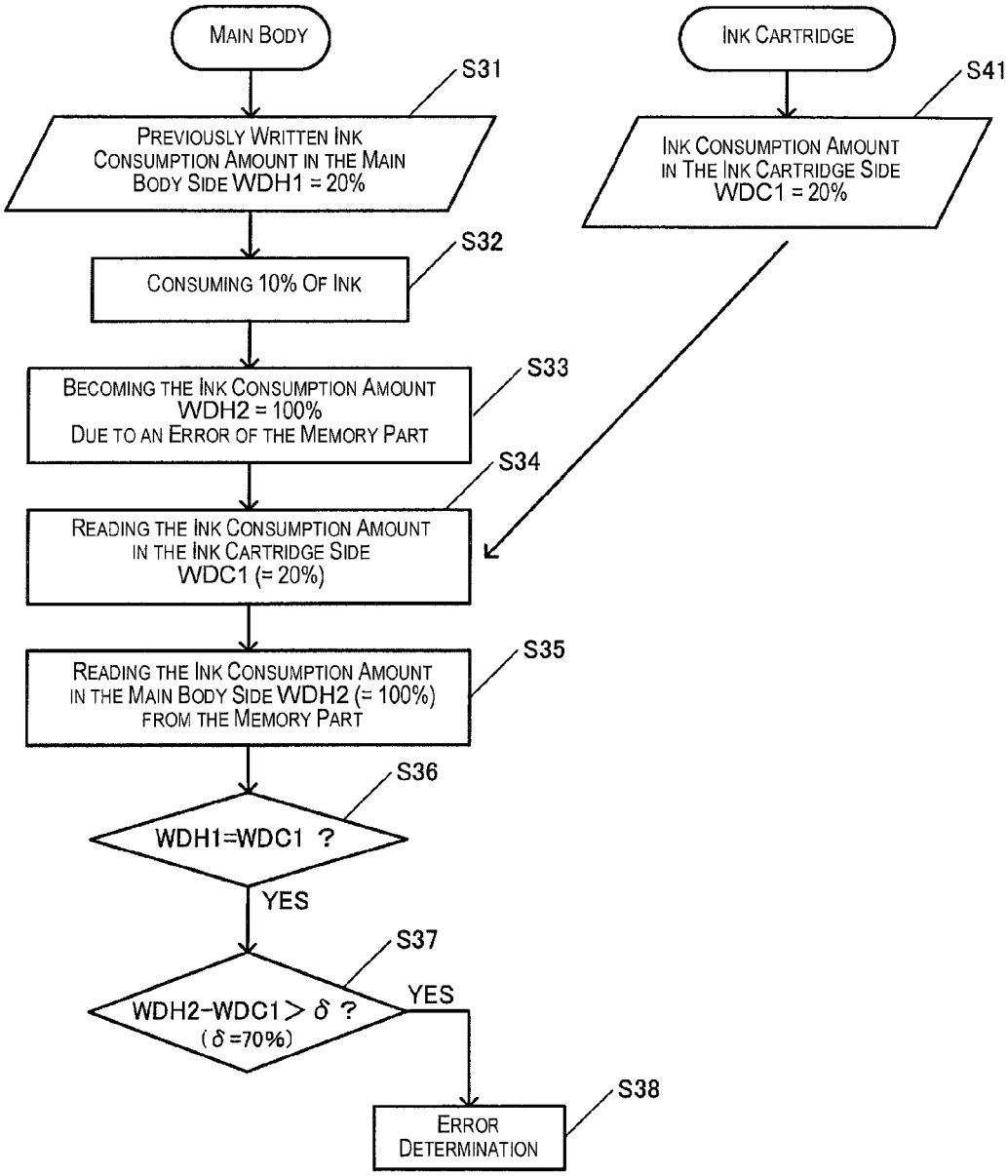
FIG. 9 The drawing is a flowchart of a configuration that includes a determination of an allowable increment.

FIG. 9 is a flowchart including the determination of the allowable increment by the printing device of the present embodiment. Steps S31 to S36 in the main body side and Step S41 in the ink cartridge side are the same flow as shown in FIG. 8 so that here, the detailed explanation is omitted.

The processing part 330 determines whether or not the increment WDH2−WDC1, which is for the received ink consumption amount in the ink cartridge side WDC1, of the ink consumption amount in the main body side after the update WDH2 is greater than the determination threshold value of the allowable increment δ. In this case, WDC2=100%, WDC1=20%, δ=70%, and WDH2−WDC1>δ so that the processing part 330 determines it as an error (Step S38). As a result, an excess ink consumption amount is not written in the memory device 130 of the ink cartridge so that it can be used for the next printing process.

In the flowchart of FIG. 9, it explained as an example that the determination threshold value of the allowable increment δ is 70%, but the determination threshold value of the allowable increment δ can be set to another value based on the above described information whether or not the cartridge is used for an initial filling, information of the ink containing amount of the cartridge, information of the nozzle number of the printing device, and the like. Because of this, it can be reduced to write an excess ink consumption amount to the memory device 130.

As described above, in the printing device of the present embodiment, when the ink consumption amount became an excess value greater than the determination threshold value of the allowable increment due to the memory error of the memory part 320, the memory device 130 in the ink cartridge side can be prevented from writing the excess ink consumption amount. As a result, it can reduce a possibility to become unusable although the ink remains in the ink cartridge. In addition, a desirable determination threshold value as the determination threshold value of the allowable increment δ can be selected among a plurality of determination threshold values based on the information of the ink containing amount of the cartridge, or the information of the nozzle number of the printing device. Because of this, it becomes possible for the error determination more accurately so that a possibility that an excess ink consumption amount is written in the memory device 130 of the cartridge can be reduced. As a result, it is possible to realize the printing device with a high reliability and user's convenience.

In the above described configurations, the case about the ink consumption amount is written to the memory device was explained, but the present invention is not limited to this case so that it may be possible to apply for other cases such that arbitrary various writing values are written in the memory device.

Also, in the above described configuration example, it applies to the printing device which uses the ink cartridge, but it is not limited to the ink cartridge. It is possible that the present invention also applies to other printing materials that contain toner, for example, a printing material container.

In the above described configuration example, it described an example that the present invention applies to the on-carriage type printing device in which the holder (cartridge installation part) is on the carriage, but it is possible that the present invention also applies to the off-carriage type printing device in which the holder (cartridge installation part) is located other than the carriage.

The present invention is not limited to the inkjet printer and the ink cartridge, and it can be applied to arbitrary liquid ejecting device, which ejects liquid other than ink, and its liquid container. For example, it is applicable for the following various liquid ejecting devices and its liquid containers: (1) an image recording device such as a facsimile device, and the like; (2) a color material ejecting device used for a color film production for an image displaying device such as a LCD display, and the like; (3) an electrode material ejecting device used for electrode formation such as an organic electro luminescence (EL) display, a field emission display (FED), and the like; (4) a liquid ejecting device that injects liquid including bioorganic substance used for biochip production; (5) a sample ejecting device as a precision pipette; (6) an ejecting device of lubricating oil; (7) an ejecting device of resin liquid; (8) a liquid ejecting device that ejects lubricating oil at pinpoint to precision instruments such as a timepiece, a camera, and the like; (9) a liquid ejecting device that injects transparent resin liquid such as ultraviolet-curing resin liquid, and the like on a substrate to form a micro hemispherical lens (optical lens) used for an optical communication element, and the like; (10) a liquid ejecting device that ejects acid or alkaline etching liquid to etch a substrate, and the like; and (11) a liquid ejecting device having a liquid ejecting head to discharge other arbitrary fine amount of liquid droplet. By the way, the term "liquid droplet" indicates the state of liquid discharged from the liquid ejecting device, and includes those trailing in a particle state, a tear drop state, and a thready state. Also, the term "liquid" here may be any material as long as the liquid ejecting device is able to eject. For example, it may be a substance in the state of liquid phase, and includes not only liquid state substance having a high or low viscosity, fluid state substance such as inorganic solvent such as sol and gel water, organic solvent, solution, liquid state resin, liquid state metal (melted metal), or liquid as a state of the substance, but also, those obtained by dissolving, dispersing, or mixing particles of functional material formed of solid state substance such as pigment or metal particles in a solvent. Representative examples of the liquid include ink as described in the above embodiment and liquid crystal. The term "ink" here includes various liquid compositions such as general water based ink, oil based ink, gel ink, hot melt ink.

The present embodiment was described in detail above, but the fact that many modifications are possible that do not substantially depart from the new matter and effects of the present invention can be easily understood by a person of ordinary skill in the art. Such modified examples are therefore all included in the scope of the present invention. For example, terms that are mentioned at least once together with different terms that are broader or identical in meaning in the specification and drawings can be substituted with those different terms at any location in the specification and drawings. The configurations and operation of the liquid consumption device, the program, and the printing device are also not limited to the descriptions of the present embodiment, and a variety of modifications are possible.

This application is based on Japanese Patent Application No. 2012-142264, the contents of which are incorporated hereinto by reference.

What is claimed is:

1. A liquid consumption device comprising:

a communication processing part that performs a communication process with a memory device provided in a liquid container that stores a liquid container side liquid consumption information;

a memory part that stores a main body side liquid consumption information; and a processing part;

wherein the processing part reads the main body side liquid consumption information from the memory part, performs a process of counting a liquid consumption amount, updates the main body side liquid consumption information based on the counted liquid consumption amount, performs a comparison process between a liquid consumption amount in the main body side based on the main body side liquid consumption information after the update and a liquid consumption amount in the liquid container side based on the liquid container side liquid consumption information that was received in the communication processing part, and when an increment of the liquid consumption amount in the main body side to the liquid consumption amount in the liquid container side is greater than a threshold value of an allowable increment, the processing part determines as a memory error of the memory part.

2. The liquid consumption device according to claim 1, wherein the processing part performs a writing process if the error was not determined so that a writing command and the main body side liquid consumption information after the update are sent to the memory device through the communication processing part, and if the error was determined, the writing process is not performed.

3. The liquid consumption device according to claim 1, wherein the threshold value of the allowable increment is more than 50% of a liquid containing amount of the liquid container.

4. The liquid consumption device according to claim 1, wherein the processing part selects any one of threshold values among a plurality of threshold values of the allowable increment, and performs a comparison process between the selected threshold value and the increment.

5. The liquid consumption device according to claim 1, wherein the processing part determines the threshold value of the allowable increment based on reference information used for determining the threshold value of the allowable increment stored in the memory device.

6. The liquid consumption device according to claim 5, wherein the reference information is information whether the liquid container is used for an initial filling.

7. The liquid consumption device according to claim 5, wherein the reference information is liquid containing amount information of the liquid container.

8. The liquid consumption device according to claim 1, wherein the processing part determines the threshold value of the allowable increment based on the reference information used for determining the threshold value of the allowable increment stored in the memory part.

9. The liquid consumption device according to claim 1, wherein the memory part stores the main body side liquid consumption information before the update, as history information, the processing part performs a comparison process between the liquid consumption amount in the main body side based on the main body side liquid consumption information before the update and the liquid consumption amount in the liquid container side based on the liquid container side liquid consumption information, and if the liquid consumption amount in the main body side before the update and the liquid consumption amount in the liquid container side are different, the error is determined.

10. A program for to enable to operate a computer as a communication processing part that performs a communication process with a memory device which is provided in a liquid container and stores a liquid container side liquid consumption information, a memory part that stores a main body side liquid consumption information, and a processing part, wherein the processing part reads the main body side liquid consumption information from the memory part, performs a process counting the liquid consumption amount, updates the main body side liquid consumption information based on the counted liquid consumption amount, performs a comparison process between the liquid consumption amount in the main body side based on the main body side information after the update and the liquid consumption amount in the liquid container side based on the liquid container side liquid consumption information that was received in the communication processing part, and when an increment of the liquid consumption amount in the main body side to the liquid consumption amount in a container side is greater than a threshold value of an allowable increment, the processing part performs a process such that a memory error of the memory part is determined.

11. A printing device characterized by including the liquid consumption device according to claim 1.

* * * * *